US005298357A

United States Patent [19]

Hattori et al.

[11] Patent Number: 5,298,357

[45] Date of Patent: Mar. 29, 1994

[54] LIQUID DEVELOPER FOR ELECTROSTATIC PHOTOGRAPHY AND DUPLICATING METHOD USING THE SAME

[75] Inventors: Hideyuki Hattori; Eiichi Kato; Kazuo Ishii, all of Shizuoka, Japan

[73] Assignee: Fuji Photo Film Co., Ltd., Kanagawa, Japan

[21] Appl. No.: 856,726

[22] Filed: Mar. 24, 1992

[30] Foreign Application Priority Data

Mar. 26, 1991 [JP] Japan ..... 3-86262

[51] Int. Cl.[5] ..... G03G 9/135; G03G 13/10

[52] U.S. Cl. ..... 430/115; 430/119; 430/137

[58] Field of Search ..... 430/115, 119

[56] References Cited

U.S. PATENT DOCUMENTS 4,734,352 3/1988 Mitchell ..... 430/115
4,886,729 12/1989 Grushkin et al. ..... 430/115 X
5,047,306 9/1991 Almog ..... 430/115
5,069,995 12/1991 Swidler ..... 430/115

FOREIGN PATENT DOCUMENTS 114428 10/1978 Japan ..... 430/115
66270 3/1987 Japan ..... 430/115

*Primary Examiner*—Roland Martin
*Attorney, Agent, or Firm*—Sughrue, Mion, Zinn, Macpeak & Seas

[57] ABSTRACT

A liquid developer for electrostatic photography which comprises a non-aqueous solvent having an electric resistance of at least $10^9$ Ω·cm and a dielectric constant of not higher than 3.5, at least toner grains comprising a resin as a main component, and (a) at least one compound (A) having an effect for increasing the amount of charge and (b) at least one compound (B) having an effect for reducing the amount of charge. There is also disclosed a duplicating method using a liquid developer as described above, which is useful for developing a large number of electrophotographic materials over a long period of time.

14 Claims, No Drawings

LIQUID DEVELOPER FOR ELECTROSTATIC PHOTOGRAPHY AND DUPLICATING METHOD USING THE SAME

FIELD OF THE INVENTION

The present invention relates to a liquid developer for use in the development of an electrostatic latent image formed by electrostatic photography and to a duplicating method using the same. More particularly, the present invention relates to a liquid developer which has improved characteristics for repeated use.

BACKGROUND OF THE INVENTION

The most important features of electrostatic photography wherein an electrostatic latent image formed in such systems as electrophotography, electrostatic recording, ink jet recording, cathode ray tube recording is converted into a visible image through a development processing, resides in that the electrostatic photographic system is simple, rapid and inexpensive as compared with silver salt photography. Further, the most important feature of liquid developers for electrostatic photography resides in that an image of high quality can be reproduced with a high resolving power as compared with dry developers for electrostatic photography.

Generally, liquid developers for electrostatic photography are obtained by dispersing organic or inorganic pigments or dyes such as carbon black, nigrosine, phthalocyanine blue, etc. and natural or synthetic resins such as alkyd resins, acrylic resins, rosin, synthetic rubbers, etc. in a liquid having high electric insulating properties and a low dielectric constant such as petroleum aliphatic hydrocarbons, and further adding a charge controlling agent such as metal soaps, lecithin, linseed oil, higher fatty acids or vinylpyrrolidone-containing polymers.

In the compositions of these liquid developers, colored grains are used in order to convert an electrostatic latent image into a visible image, and resin grains are used to improve the fixation of the image and to keep the strength of the image. Grains comprising a coloring component as well as a fixing component may also be used.

Charge controlling agents for imparting positive charge or negative charge to these grains are used to thereby form electricity detecting toner grains.

The electricity detecting toner grains must have strong and stable charges. Particularly, in recent years, line originals and halftone originals as well as the originals of continuous tone images have been markedly increased as originals to be duplicated (copied).

The chargeability of the toner grains is very important to reproduce the faithfully duplicated (copied) images of such fine originals. When the chargeability is insufficient, the desired image density cannot be obtained, and images formed tend to have a flow defect (so-called streak) and further the deposition of the toner grains on non-image areas (fog) tends to occur.

Charge controlling agents for reducing or eliminating such a phenomenon as described above have been developed, and such agents include semi-alkylamide compounds of maleic acid copolymers as disclosed in JP-B-49-26594 (the term "JP-B" as used herein means an "examined Japanese patent publication") (U.S. Pat. No. 4,062,789), JP-A-60-179750 (the term "JP-A" as used herein means an "unexamined published Japanese patent application"), and metal salts of N,N-dialkylaminoalkanecarboxylic acids and metals salts of N,N-dialkylaminoalkanesulfonic acids as disclosed in JP-A-60-21056.

A change in an image quality and sensitivity caused by repeated development of a large number of electrophotographic materials (hereinafter sometimes referred to as plates) must be minimized as much as possible to keep the practical features, i.e., simplicity, rapidness and low cost of electrostatic photography as well as high image quality of the liquid developers. Generally, when development is repeatedly carried out a great number of times, changes in the image quality such as the image density or the gradation and the sensitivity may occur with a reduction in the concentration of the toner grains and with a change in the composition of the developer. When the image quality is changed, high image quality which is one of the advantages of the liquid developer cannot be obtained. When sensitivity is changed, the control of an exposure amount is required and simplicity and rapidness which are the advantages of electrophotography cannot be attained. Further, in developing a great number of plates repeatedly with the same developer, if image quality and sensitivity are greatly changed, it is necessary that a developer is frequently replaced with a new one, and thus the advantages of simplicity, rapidness and low cost are reduced.

When a great number of plates, for example, 1000 plates or more, are developed with conventional liquid developers, image quality is greatly changed, and hence developing apparatuses are so designed that the apparatuses are provided with an automatic controlling device to keep the concentration of toner grains in the developing tank constant. However, such a means for keeping the concentration of toner grains constant causes other problems such as an increased cost for apparatuses and complicated structures of the apparatuses, thereby causing machine troubles and time-consuming works for maintaining the apparatuses.

In order to overcome these problems, a proposed liquid developer containing further branched aliphatic alcohols having not less than 12 carbon atoms has been proposed in JP-B-63-55063.

Further, JP-A-57-210384 discloses a method wherein the concentration of a developer used for replenishment during the repeated use is higher than that of a developer used at starting of the development, and JP-A-48-90236 and JP-A-64-32278 disclose a method wherein an amount of a charge controlling agent used is reduced in a developer for replenishment and the resulting developer is replenished.

However, these techniques are still insufficient with respect to the characteristics required for stably duplicating highly fine original images including continuous tone images presently required over a long period of time. Further, it is still more required that the original images are stably reproduced by electrostatic photography even when environmental conditions are greatly changed to such as low temperature and low humidity conditions or high temperature and high humidity conditions. Furthermore, even in electrostatic photography using a liquid developer, a requirement for easy maintenance comparative to the dry developer system has recently been desired.

Accordingly, developments of a liquid developer having excellent repeated use characteristics and a duplicating method using the same are important matters.

SUMMARY OF THE INVENTION

An object of the present invention is to provide a liquid developer for electrostatic photography which scarcely causes a change in an image- quality and sensitivity when a large number of electrophotographic materials are developed.

Another object of the present invention is to provide a duplicating method excellent in repetition characteristics without causing substantial changes in the image quality and the sensitivity when a large number of electrophotographic materials are developed.

Still another object of the present invention is to provide a liquid developer excellent in repetition characteristics even when environmental conditions are changed, and a duplicating method using the same.

The above-described objects of the present invention can be accomplished by a liquid developer for electrostatic photography, a combination of a liquid developer and a replenisher therefor, and a duplication method using the same as described below.

Accordingly, the present invention provides a liquid developer for electrostatic photography which comprises a non-aqueous solvent having an electric resistance of at least $10^9$ Ω·cm and a dielectric constant of not higher than 3.5, at least toner grains containing a resin as a main component, and (a) at least one compound (A) having an effect for increasing the amount of charge and (b) at least one compound (B) having an effect for reducing the amount of charge.

The present invention also provides a combination of (1) the above-described liquid developer for electrostatic photography and (2) a replenisher for the above-described liquid developer for electrostatic photography wherein the composition of the replenisher is adjusted to such that the weight ratio (A)/(B) of the compound (A) to the compound (B) contained in the replenisher is at least 0.1 time, but less than 1.0 time the weight ratio (A)/(B) of the compound (A) to the compound (B) contained in the fresh liquid developer used at the commencement of development.

The present invention further provides a duplicating method which comprises conducting electrostatic duplication with a liquid developer for electrostatic photography which comprises a non-aqueous solvent having an electric resistance of at least $10^9$ Ω·cm and a dielectric constant of not higher than 3.5, toner grains mainly composed of a resin, and (a) a compound (A) having an effect for increasing the amount of charge and (b) a compound (B) having an effect for reducing the amount of charge.

In a preferred embodiment of the above duplicating method, the composition of the replenisher is adjusted to such that the weight ratio (A)/(B) of the compound (A) to the compound (B) contained in the liquid developer for use in replenishment is at least 0.1 time, but less than 1.0 time the weight ratio (A)/(B) of the compound (A) to the compound (B) contained in the fresh liquid developer used at the commencement of development.

In a further preferred embodiment, the liquid developer of the present invention further comprises a coloring agent.

DETAILED DESCRIPTION OF THE INVENTION

General purpose liquid developers for electrostatic photography are designed such that toner grains are dispersed in a non-aqueous solvent (carrier) having a high insulating property and a low dielectric constant and further a charge controlling agent and the amount thereof are adjusted to keep the generation of charge on the grains and a given amount of charge. In such developers, the charge controlling agent used is dissolved in the carrier, but 100% of the charge controlling agent used is not always efficiently bonded to the toner grains.

Accordingly, some of the charge controlling agent is contained in the developer without being bonded to the toner grains. In certain cases, some of the charge controlling agent exists in the developer in such a state that the charge controlling agent is unstably bonded to the toner grains and is apt to be diffused in the carrier.

Thus, when development is repeatedly carried out while replenishing a fresh liquid developer as a replenisher which has the same composition as that of a fresh liquid developer (hereinafter referred to as fresh tank liquid or mother liquid) used in the developing tank at the commencement of development in the repeated reproduction of a large number of plates, the grains are consumed as images, but a concentration of the charge controlling agent diffused in the carrier is gradually increased and, as a result, the balance of the composition of the developer is gradually changed. The increase in the concentration of the charge controlling agent and the change of the balance of the ingredients cause an increase in the charge of the grains or an increase in the charge in the carrier, thereby lowering the amount of the grains deposited on the electrostatic latent image and lowering the density of image.

To improve the repetition characteristics, a method has been proposed wherein a liquid developer containing no charge controlling agent is replenished as a developer to be replenished (replenisher) or a replenisher containing a charge controlling agent at a concentration lower than that of the charge controlling agent contained in the fresh liquid developer (mother liquid) used at the commencement of the development is replenished, whereby stability of repeated use can be improved. However, when the concentration of the charge controlling agent is lowered, there are disadvantages that the amount of charge on the grains is reduced, an electrostatic repulsive force between the grains is reduced and the agglomeration of the grains is liable to be caused. Further, with the above proposed method, stability is still insufficient when the method is repeatedly used over a long period of time.

The liquid developer of the present invention is totally different from conventional liquid developers in which the generation of charge on the toner grains and the control of the amount of charge are adjusted by a compound having a function capable of generating charge and an amount of the compound. As set forth above, 100% of the compound (A) used which is capable of generating charge is not always effectively utilized by the toner grains, and thus the compound (A) in the carrier causes a change in the amount of charge on the toner grains by the fluctuation of the concentrations of the toner grains and the compound (A). The present invention is characterized in that the change in the amount of charge on the toner grains is reduced or eliminated by using the compound (B) capable of reducing the amount of charge on the toner grains in combination with the compound (A).

In this manner, it has become possible that about 3,000 electrophotographic materials having clear duplicated images can be developed over a long period of time, in contrast to the number of duplication having clear duplicated images of at most about 1,000 obtained by the conventional developer and the conventional duplicating method.

Further, when the developer having the weight ratio (A)/(B) of the compound (A) for generating charge to the compound (B) for inhibiting charge is lower than the weight ratio (A)/(B) of the compound (A) to the compound (B) contained in the developer (mother liquid) used at the commencement of development is used as the developer for use in replenishment (replenisher) to stabilize the repetition characteristics, it has become possible that 10,000 or more electrophotographic materials can be developed over a long period of time.

This is considered due to the fact that, when the developer is repeatedly used over a long period of time, the charge generating compound (A) is prevented from being accumulated and concentrated in the developer contained in the developing apparatus, and the prevention effect by the charge inhibiting compound (B) is increased.

Furthermore, in conventional techniques, when environmental conditions during the duplication are changed to low temperature and low humidity conditions (e.g., 15° C., 20% RH) or high temperature and high humidity conditions (e.g., 30° C., 80% RH), the density of duplicated image is lowered and the background fog in the non-image area is greatly increased. However, when the developer and the duplicating method of the present invention are used, these phenomenons can be greatly improved.

This is considered that an amount of charge on the toner grains and an amount of charge in the carrier are not changed and are maintained stably even when the environmental conditions are changed during the duplication processing, as described above.

The liquid developer of the present invention is described in more detail below.

The liquid developer of the present invention is characterized in that the charged state is controlled by using the compound (A) having an effect of increasing the amount of charge on the toner grains dispersed in the aforesaid non-aqueous solvent as a carrier (the compound (A) is hereinafter referred to as charge generating agent (A)) and the compound (B) having an effect of reducing the amount of charge on the toner grains dispersed in the non-aqueous solvent (the compound (B) is hereinafter referred to as charge inhibiting agent (B)), and in that, in order to ensure the repeated use of the liquid developer over a long period of time, the weight ratio (A)/(B) of the charge controlling agents, i.e., the compound (A) to the compound (B), contained in the liquid developer for use in replenishment (replenisher) is adjusted to at least 0.1 time, but less than 1.0 time (preferably 0.1 to 0.95 times, particularly preferably 0.3 to 0.8 times) the weight ratio (A)/(B) of the compound (A) to the compound (B) contained in the liquid developer (mother liquid) used at the commencement of development.

The charge generating agent (A) is described in detail below.

The compound (A) is used in an amount of about 0.0001 to about 1 parts by weight, preferably 0.005 to 0.5 parts by weight, per 1,000 parts by weight of the non-aqueous solvent (carrier) of the present invention. When the amount of the compound (A) is less than about 0.0001 part by weight, the charged state (the amount of charge) of the toner grains becomes unstable, the density of the duplicated image is insufficient and the streak of the image tends to occur. When the amount is more than 1 part by weight, the amount of the compound dissolved in the carrier increases, the amount of charge (ion) in the carrier increases and, as a result, the streak of the image also tends to occur.

The charge generating agent (A) may be any of the conventional compounds known as charge adjusting agents (or controlling agents).

Examples of compounds (A) which can be used in the present invention include metal salts of fatty acids such as naphthenic acid, octenoic acid, oleic acid and stearic acid; metal salts of sulfosuccinates; metal salts of oil-soluble sulfonic acids as described in JP-B-45-556, JP-A-52-37435 and JP-A-52-37049; metal salts of phosphoric acid esters as described in JP-B-45-9594; metal salts of abietic acid or hydrogenated abietic acids as described in JP-B-48-25666; calcium salts of alkylbenzenesulfonic acids as described in JP-B-55-2620; metal salts of aromatic carboxylic acids or sulfonic acids, nonionic surfactants such as polyoxyethylated alkylamines, fats and oils such as lecithin and linseed oil, polyvinyl pyrrolidone, organic acid esters of polyhydric alcohols as described in JP-A-52-107837, JP-A-52-38937, JP-A-57-90643 and JP-A-57-139753; phosphoric ester surfactants as described in JP-A-57-210345; and sulfonic acid resins as described in JP-B-56-24944. Further, amino acid derivatives as described in JP-A-60-21056 and JP-A-61-50951 can be used. The amino acid derivatives include compounds represented by the following formula (1) or (2) and reaction mixtures obtained by reacting an amino acid with a titanium compound in an organic solvent, mixing the resulting reaction mixture with water and further reacting the resulting mixture.

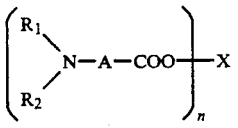

(1)

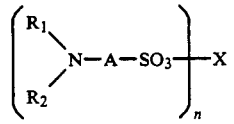

(2)

In general formulae (1) and (2), $R_1$ and $R_2$ each represents a hydrogen atom, an alkyl group or a substituted alkyl group having 1 to 22 carbon atoms (examples of substituent groups include a dialkylamino group, an alkyloxy group and an alkylthio group), an aryl group or a substituted aryl group having 6 to 24 carbon atoms (examples of substituent groups include a dialkylamino group, an alkyloxy group, an alkylthio group, a chloro atom, a bromo atom, a cyano group, a nitro group and a hydroxyl group), an aralkyl group, an acyl group having 1 to 22 carbon atoms, an alkylsulfonyl group, an alkylphosphonyl group, an arylsulfonyl group having 6 to 24 carbon atoms or an arylphosphonyl group having 6 to 24 carbon atoms. $R_1$ and $R_2$ may be the same or different, or $R_1$ and $R_2$ may be combined together to form a ring. $R_1$ and $R_2$ cannot be simultaneously hydrogen atoms. A represents an alkylene group or a substituted alkylene group having 1 to 10 carbon atoms; X represents hydrogen atom, a monovalent to tetravalent metal or a quaternary ammonium cation; and n represents a positive integer.

Furthermore, semialkylamide compounds of maleic acid copolymers as described in U.S. Pat. No. 4,579,803 and JP-A-60-179750 can be used. These copolymers are carrier-soluble polymers having at least a repeating unit represented by the following general formula (3).

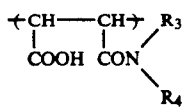

(3)

In general formula (3), $R_3$ and $R_4$ have the same meaning as $R_1$ and $R_2$ in general formula (1).

Among these compounds, preferred compounds include metal salts of naphthenic acid, metal salts of dioctyl sulfosuccinate, lecithin, the amino acid derivatives described above, and the semialkylamide compounds of the maleic acid copolymers described above.

These charge generating agents (A) may be used either alone or in a combination of two or more agents.

Next, the charge inhibiting agent (B) is described in detail below.

The compound (B) is used in an amount of about 1 to about 500 parts by weight, preferably 10 to 150 parts by weight per 1,000 parts by weight of the carrier of the present invention. When the amount of the compound (B) is less than about 1 part by weight, an insufficient density of the duplicated image or the streak of the image tend to occur in the case of repeated application. When the amount is more than about 500 parts by weight, the same phenomenons as described above occur, and repetition stability characteristics are reduced.

Examples of the compound which can be used as the charge inhibiting agent in the present invention include low-molecular organic compounds having at least one hydroxyl group per molecule (e.g., alcohols having a branched aliphatic group having not less than 12 carbon atoms as described in JP-B-63-55063; diols having not less than 6 carbon atoms in total and polyols as described in *High-Molecular Data Handbook* (foundation part), pp. 281-326, edited by High-Molecular Material Society, published by Baifukan (1986)); macrocyclic compounds having an oxygen atom, a sulfur atom and/or a nitrogen atom called crown ether or cryptand, and polymers having macrocyclic heterocyclic group (e.g., R. M. Izatt, J. J. Christensen, *Synthetic Multidentate Macrocyclic Compounds*, Chapter I, Academic Press (New York) (1978); compounds described in *Crown Ether Chemistry*, special chemical number 74, written by Ryohei Oda, Toshiyuki Shono and Haruo Tabushi, published by Kagaku Dojin (1978)); polyethers and polyesters having a weight average molecular weight of 500 to $1\times10^{-4}$ and an —O— bond and/or a —COO— bond in the polymer main chain thereof (e.g., compounds as described in *Oligomer Handbook*, prepared under the supervision of Mr. Junji Furukawa published by Kagaku Kogyo Dohosha (1977), *Newest Application Technique of Oligomers*, edited by Michio Hiraoka published by CMC (1983)); and oligomers wherein terminal hydroxyl groups and/or terminal carboxyl groups of the polymer main chains of the above polyethers or the above polyesters are modified by an ether group and/or an ester group (e.g., compounds as described in the literature cited in the above polyethers and polyesters).

These charge inhibiting agents (B) may be used either alone or in a combination of two or more agents.

The important characteristics for the compounds are that the charge inhibiting agent (B) is a hydrocarbon compound having not less than 6 carbon atoms in total and containing a hetero-atom of oxygen, sulfur or nitrogen and/or an oligomer composed of a repeating unit of the above hydrocarbon compound, and that the above hydrocarbon compound and the oligomer have a solubility in toluene solvent such that at least one part by weight of the charge inhibiting agent (B) is soluble in 100 parts by weight of a toluene solvent at a temperature of 25° C.

As described above, the present invention is characterized in that the liquid developer contains the charge generating agent (A) and the charge inhibiting agent (B) in a combination in an arbitrary ratio, and in that the duplicating method is conducted using the liquid developer which is controlled-so that the weight ratio (A)/(B) of the compound (A) to the compound (B) contained in the replenisher is lower than the weight ratio (A)/(B) of the compounds contained in the fresh liquid developer (mother liquid) used at the commencement of development in order to stabilize the repetition characteristics over a long period of time.

Namely, the compound (A) and the compound (B) are used in the mother liquid and the replenisher in the range of $0.1 \leqq R_b/R_a < 1.0$, preferably $0.1 \leqq R_b/R_a \leqq 0.95$, particularly preferably $0.3 \leqq R_b/R_a \leqq 0.8$, wherein $R_a$ represents the weight ratio (A)/(B) of the compound (A) to the compound (B) used in the mother liquid and $R_b$ represents the weight ratio (A)/(B) of the compound (B) to the compound (B) used in the replenisher, each amount of the compounds (A) and (B) being based on 1000 parts by weight of the total composition of the developer.

The weight ratio (A)/(B) in the mother liquid and the replenisher within the range of $0.1 \leqq R_b/R_a < 1.0$ varies depending on the types of the dispersed toner grains used and the types of the charge generating agent (A) and the charge inhibiting agent (B), but can be properly set by the combination thereof.

When the ratio of $R_b/R_a$ is lower than 0.1 or exceeds 1.0, problems may occur such that the stability of the repetition characteristics is lowered, the density of the duplicated image is lowered, and the streak of the image occurs.

Preferred examples of the non-aqueous solvents (carriers) having an electric resistance of at least $10^9$ Ω·cm and a dielectric constant of not higher than 3.5 which can be used in the present invention include straight-chain or branched aliphatic hydrocarbons, alicyclic hydrocarbons, aromatic hydrocarbons and halogenated hydrocarbons. Of these compounds, octane, isooctane, decane, isodecane, nonane, dodecane, isododecane, decaline, and isoparaffinic petroleum solvents such as Isopar E, Isopar G. Isopar H, Isopar L (trade names, products of Exxon Co.), Shellsol-71 (trade name, a product of Shell Oil Company) and Amsco OMS (trade name, a product of American Mineral Spirits Co.) are more preferred from the viewpoints of volatility, stability, toxicity and odor. These solvents may be used singly or as a mixture of two or more solvents.

Any of conventional toner grains can be used in the present invention without particular limitation. For example, any of resins which are substantially insoluble in the non-aqueous solvents set forth above can be used as the main constituent components of the toner grains.

Specific examples of the resins include synthetic or natural resins such as acrylic resins, methacrylic resins, polyvinyl alkanoate resins, amide resins, alkylene resins, phenol-modified alkyl resins, epoxy resins, rosin resins, polycarbonate resins, styrene resins and synthetic rubber. Resin dispersions which can be used in the liquid developers of the present invention can be prepared by conventional methods known to those skilled in the art. For example, the resin dispersions can be prepared by the methods wherein the desired resin is dispersed in a nonpolar solvent by means of a ball mill or a high-speed agitator.

Further, the resin dispersions can be prepared according to the methods as described in JP-A-61-292645, JP-A-62-75651, JP-A-64-66666, JP-A-1-216367 and JP-A-1-285955.

Furthermore, a method (so-called polymer granulation method) is known wherein a monomer is polymerized in the non-aqueous solvent to obtain a resin dispersed therein. Such resin dispersions can be prepared according to the methods described in, for example, E. J. Barrett, *Dispersion Polymerization in Organic Media,* John Willey and Sons, London (1974), U.S. Pat. Nos. 3,637,569, 3,753,760, 4,840,865, 4,618,557 and 4,842,975, JP-A-60-185962, JP-A-2-74956, JP-A-2-271365 and JP-A-2-173667.

It is desirable that the grain sizes of the resulting resin dispersions are controlled so as not to be larger than 5 μm, particularly preferably not larger than 1 μm in order to obtain continuous tone images.

If desired, coloring agents can be used as a component of the toner grains. Any of conventional pigments or dyes can be used as the coloring agents without any particular limitation.

Examples of black coloring agents include carbon black, Aniline Black (manufactured by Imperial Chemical Industries Ltd. U.K., hereinafter abbreviated as ICI), Cyanine Black BX (manufactured by Sumitomo Chemical Co., Ltd.), Mogal A (manufactured by Gotfrey L Cabonet Co., U.S.A., hereinafter abbreviated to as Cabonet), Spiron Black (manufactured by Hodogaya Kagaku Co., hereinafter abbreviated as Hodogaya), Monolite Fast Black BX (ICI), Spirit Black (manufactured by Orient Kasei Co., hereinafter abbreviated as Orient), and Microlith Black (Ciba). Examples of red coloring agents include Spiron red (Hodogaya), Spiron Orange (Hodogaya), Benzine Orange (manufactured by Sanyo Shikiso Co., hereinafter abbreviated as Sanyo), Brilliant Carmine 6B (Sanyo), Scarlet KR (Sanyo), Fast Red (Sanyo), Fast Rose 836 (manufactured by Dainichiseika Color & Chemicals Mfg. Co., Ltd., hereinafter abbreviated as Dainichiseika) and Monolite Fast Red B (ICI). Examples of yellow coloring agents include Spiron Yellow (Hodogaya), Benzine Yellow GNN (Sanyo), Benzine Yellow 471 (Dainichiseika) and Monolite Fast yellow IDG (ICI). Examples of blue coloring agents include victoria Blue (Hodogaya), Methylene Blue (Hodogaya), Oil Blue (Orient), Alkali Blue (Dainichiseika), Sky Blue (Sanyo), Cyanine Blue FG (Sanyo), Cyanine Blue NSG (Dainichiseika), Phthalocyanine Blue and Lignol Blue (manufactured by Toyo Ink Mfg. Co., Ltd.), Monastral Fast Blue G (ICI) and Balli Fast Blue (Orient). Examples of green coloring agents include Phthalocyanine Green LL (Sanyo), Phthalocyanine Green LX (Sanyo), Seikalite Green Lak #4554 (Dainichiseika) and Chlomo Fine Green (Dainishiseika). Example of other coloring agent includes Spiron Violet (purple, Dainishiseika.).

When light-transmissive electrophotographic films are developed, white pigments such as barium sulfate, titanium oxide, zinc oxide and magnesium oxide can be used.

These coloring agents may be dispersed singly in the non-aqueous solvent in the presence of optionally a dispersion accelerator. Graft type grains (e.g., Graft Carbon, trade name, a product of Mitsubishi Gas Chemical Company, Inc.) formed by chemically bonding a polymer to the surface of the coloring agent may be used. The coloring agents may be previously incorporated into the above-described resins.

Examples of methods for coloring the dispersed resins include conventional methods wherein the coloring agents are physically dispersed by means of a dispersion device such as a paint shaker, a colloid mill, a vibration mill or a ball mill as described in JP-A-48-75242. Pigments and dyes which can be used in these coloring methods include those already described above.

Other coloring methods include those wherein the dispersed resins are dyed with the desired dyes by heating as described in, for example, JP-A-57-48738. Examples of dyes which can be used in the coloring methods include Hansa Yellow, Crystal Violet, Victoria Blue, Malachite Green, Celliton Fast Red, Disperse Yellow, Disperse Red, Disperse Blue and Solvent Red.

Still another coloring methods include those wherein the dispersed resins are chemically bonded to the dyes such as a method wherein a resin is reacted with a dye as described in, for example, JP-A-53-54029 and a method wherein a monomer capable of being converted into an insolubilized dispersible resin by polymerization is previously bonded to a dye as described in, for example, JP-B-44-22955.

Conventional dispersion stabilizers can be used to disperse stably the above-described resins or the above-described coloring agents in the non-aqueous solvents. Namely, various synthetic or natural resins singly or in combination of two or more thereof can be used. Examples of the resins which can be used include homopolymers of a monomer such an alkyl ester of acrylic acid or methacrylic acid (in which the alkyl moiety has 4 to 30 carbon atoms, may be substituted with a halogen atom, a hydroxyl group, an amino group, an alkoxy group, etc., and the carbon-carbon bond of the main chain thereof may have an intervening hetero-atom such as an oxygen atom), vinyl ester of a fatty acid, a vinyl alkyl ether or an olefin such as butadiene, isoprene or diisoprene, copolymers of two or more monomers thereof, and copolymers of a monomer capable of forming a polymer soluble in the above-described aliphatic hydrocarbon solvents with one or more monomers described below.

Examples of such monomers for use in the production of the above copolymers include vinyl acetate, methyl, ethyl, n-propyl or isopropyl ester of acrylic acid or methacrylic acid; styrene and derivatives thereof such as vinyltoluene and α-methylstyrene; unsaturated carboxylic acids and anhydrides thereof such as acrylic acid, methacrylic acid, crotonic acid, maleic acid, itaconic acid and maleic anhydride; and monomers having a polar group such as a hydroxyl group, an amino group, an amido group, a cyano group, a sulfo group, a carbonyl group, a halogen atom or a heterocyclic ring such as hydroxymethyl methacrylate, hydroxyethyl methacrylate, diethylaminoethyl methacrylate, N-vinylpyrrolidone, acrylamide, acrylonitrile, 2-chloroethyl methacrylate and 2,2,2-trifluoroethyl methacrylate. In addition to the above-described synthetic resins, alkyd resins, fatty acid-modified alkyd resins, modified polyurethane resins and natural resins such as linseed oil can also be used.

The amount of each of main components contained in the liquid developer of the present invention is described below.

The toner grains mainly composed of the resin and the coloring agent are used in an amount of preferably 0.5 to 50 parts by weight per 1,000 parts by weight of the non-aqueous solvent (carrier). When the amount thereof is less than 0.5 parts by weight, the density of the image is insufficient, and, when the amount is more than 50 parts by weight, the non-image areas are liable to be fogged. The resins which are soluble in the non-aqueous solvent, such as the above-described dispersion stabilizers, can be optionally used and are incorporated in an amount of 0.5 to 100 parts by weight per 1,000 parts by weight of the non-aqueous solvent.

The liquid developer of the present invention can be prepared in a conventional manner, for example, by thoroughly kneading a toner grains and the resin as a dispersion stabilizer with a small amount of the non-aqueous solvent to form a concentrated toner, and then diluting it with the non-aqueous solvent. When the resin which is insoluble in the non-aqueous solvent is used as the dispersion stabilizer, the resin and the toner grains are thoroughly kneaded in a solvent in which the resin is soluble, and the resulting kneaded product is diluted with the non-aqueous solvent. When toner grains obtained by granulation during polymerization are used, the above kneading operation can be eliminated. The charge generating agent (A) may be added during or after kneading. A predetermined amount of the charge inhibiting agent (B) may be added during the course of the preparation of the concentrated toner or the diluted toner.

If desired, various additives may be added. Examples of such additives include those described in Yuji Harasaki, *Denshi Shashin,* Vol. 16, No. 2, page 44.

The upper limit of the total amount of the additives for the liquid developer is set by the electric resistance of the developer. If the liquid developer from which the toner grains are removed has an electric resistance of less than $10^9$ Ω·cm, it is difficult to obtain a continuous tone image of a good quality, and, hence, the amount of each additive to be added should be controlled so as to meet the above requirement of the electric resistance.

The liquid developers of the present invention can be used for the development of the electrostatic latent images formed by any method.

Examples of methods for forming an electrostatic latent image are described in, for example, *Recording Material and Light-Sensitive Resins,* edited by Isamu Shinohara, Hidetoshi Tsuchida and Hideaki Kusakawa, published by Gakkai Shuppan Center (1983). Typical examples thereof include an electrophotographic process, an electrostatic recording method, and, an ink jet recording method. The electrophotographic process is practically used for various proposes because it produces fine images including continuous tone images, and also the process is a highly sensitive recording method. Thus, the developer of the present invention is particularly useful for the electrophotographic process.

In the electrophotographic process, the developers of the present invention can be used for any of the electrophotographic materials using a conventional organic or inorganic photoconductive material.

Examples of the electrophotographic materials include those described in Harumi Miyamoto and Hidehiko Takei, *Imaging,* 1973, No. 8, p. 2; R. M. Schaffert, *Electrophotography Focal/Hastings Hous* (New York) (1980); and *Recent Development and Practical Use of Photoconductive Material and Sensitive Material,* edited by Hiroshi Kokado, published by Shuppanbu of Nippon Kagaku Joho KK (1986), and any of these materials can be used. Further, the developer of the present invention can be used for any of PPC system and CPC system.

The liquid developers of the present invention can be applied to not only black-and-white duplicated images but also color duplicated images when used in combination with the colored toner grains (e.g., methods described in Kuro Takizawa, Shasin Kogyo, 33, 34 (1975) and Masayasu Anpo, *Denshi Tsushin Gakkai Gijutsu Kenkyu Hokoku,* 77. 17 (1977).

Further, the liquid developers of the present invention can be effectively used for other applications in the latest systems which utilize electrophotographic process. For example, the liquid developers of the present invention can be used in the fields of various electrophotographic plate making systems which are applied to the original plates for offset lithographic printing, recording materials for block copy used in offset printing process and color proofs.

The present invention is now illustrated in greater detail by the following examples which, however, are not to be construed as limiting the present invention in any way.

EXAMPLE 1 AND COMPARATIVE EXAMPLE A

Preparation of Dispersed Resin Particles L-1

A mixed solution of 16 g of poly(octadecyl methacrylate), 100 g of vinyl acetate, 4 g of stearyl methacrylate and 385 g of Shellsol 71 was heated to 70° C. with stirring in a nitrogen stream. Subsequently, 1.7 g of 2,2'-azobis(isovaleronitrile) (hereinafter abbreviated as A.I.V.N.) was added thereto, and the mixture was reacted for 2 hours. Further, 0.5 g of A.I.V.N. was added thereto, and the mixture was reacted for 2 hours. The temperature of the reaction mixture was raised to 100° C. and the reaction mixture as such was stirred to distil off unreacted vinyl acetate. The reaction mixture was cooled and filtered through a 200-mesh nylon cloth to obtain a white resin dispersion having an average particle size of 0.22 μm at a polymerization ratio of 88%.

The average particle size of the particles was measured by CAPA-700 (manufactured by Horiba Seisakusho KK).

Preparation of Colored Particles D-1

10 g of poly(lauryl methacrylate), 10 g of Nigrosine and 30 g of Shellsol 71 together with glass beads were placed in a paint shaker and dispersed for 2 hours to obtain a fine dispersion of Nigrosine.

A 5.3 g portion (on a solid basis) of the above dispersed resin particles (L-1), 4.2 g (on a solid basis) of the above colored particles (D-1), 17 g of branched hexadecyl alcohol FOC-1600 (manufactured by Nissan Chemical Industries, Ltd.) and 0.02 g of a polymer (A-1) having the following structure were dispersed and dissolved in one liter of Isopar H to prepare a liquid developer.

Polymer (A-1)

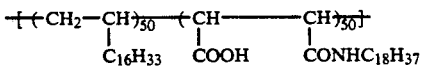

(by weight)
Mw 1.5 + $10^4$

Comparative Liquid Developer A

The procedure of Example 1 was repeated except that 17 g of FOC-1600 (B-1) used in Example 1 was omitted to prepare a liquid developer.

ELP Master II type electrophotographic material (manufactured by Fuji Photo Film Co., Ltd.) was exposed and developed by using these liquid developers as a developer for mother liquid and a developer for replenishment in a full automatic plate making machine ELP 310 II (manufactured by Fuji Photo Film Co., Ltd.). The plate marking speed was 3 plates/min.

The number of plates obtained with the liquid developer of the present invention and the comparative liquid developer until cut of fine lines and blurring on the image areas of the duplicated image appeared on the photographic material after plate making was counted.

When the developer of the present invention was used, 3,500 plates having a clear image were obtained, while when comparative developer A was used, only 1,000 plates were obtained.

Thus, it is clear that excellent performance can be obtained only by the developer of the present invention and the duplicating method using the developer.

EXAMPLES 2 TO 7

The procedure of Example 1 was repeated except that the compounds indicated in Table 1 were used in place of 0.02 g of the charge generating agent (A-1) and 17 g of the charge inhibiting agent FOC-1600 (B-1) used in Example 1 to prepare liquid developers.

Development were carried out in the same manner as in Example 1 by using the resulting liquid developers, and excellent performance similar to that obtained in Example 1 was obtained.

TABLE 1

| Example | Charge generating agent (A) | (amount used) | Charge inhibiting agent (B) (amount used) |
|---|---|---|---|
| 2 | (A-2) 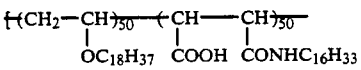 | (0.018 g) | (B-2) branched octadecyl alcohol FOC-1800 (15 g) |
| 3 | (A-3) 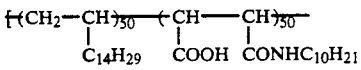 | (0.022 g) | (B-3) branched tetradecyl alcohol FOC-1400 (18 g) |
| 4 | (A-4) 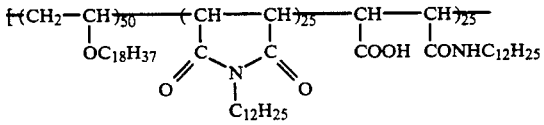 | (0.020 g) | (B-2) (18 g) |
| 5 | (A-5) Zirconium naphthenate | (0.06 g) | (B-4) 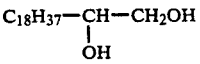 (10 g) |
| 6 | (A-6) 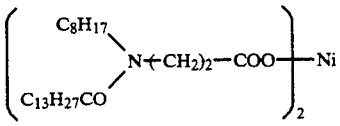 | (0.07 g) | (B-5) 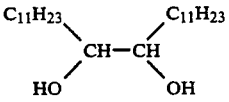 (10 g) |
| 7 | (A-7) 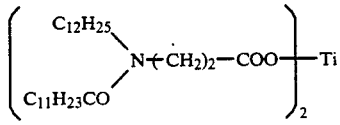 | (0.08 g) | (B-6) 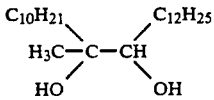 (11 g) |

EXAMPLE 8 AND COMPARATIVE EXAMPLES B AND C

Preparation of Resin Particles L-2

A mixed solution of 99.7 g of octadecyl methacrylate, 0.3 g of divinylbenzene and 200 g of toluene was heated to 85° C. with stirring in a nitrogen atmosphere. Subsequently, 3 g of 2,2'-azobis(isobutyronitrile) (hereinafter abbreviated as A.I.B.N.) was added thereto, and the mixture was reacted for 4 hours. Further, 1 g of A.I.B.N. was added thereto, and the mixture was reacted for 4 hours. The resulting copolymer had a weight average molecular weight of $4\times10^4$.

A mixed solution of 25 g (on a solid basis) of the above-obtained copolymer, 100 g of vinyl acetate and 380 g of Isopar H was heated to 70° C. with stirring in a nitrogen stream. To the mixed solution was added 1.0 g of A.I.V.N., and the mixture was reacted for 3 hours. Further, 0.5 g of A.I.V.N., was added thereto, and the mixture was heated to 75° C. to affect the reaction for 2 hours. The reaction mixture was heated to 100° C. to distil off unreacted vinyl acetate. The reaction mixture was cooled and filtered through a 200-mesh nylon cloth. The resulting white resin dispersion had an average particle size of 0.23 μm and a polymerization ratio of 86%.

Preparation of Colored Particles D-2

10 g of a dodecyl methacrylate/acrylic acid copolymer (copolymerization ratio: 95/5 by weight), 8 g of Alkali Blue and 30 g of Isopar H were placed in a paint shaker together with glass beads and dispersed for 2 hours to obtain a fine dispersion of Alkali Blue.

Liquid Developer for Mother Liquid 7 g (on a solid basis) of the above-described dispersed resin particles (L-2). 0.8 g (on a solid basis) of the above described colored particles, 13 g of FOC-1400 (B-3) and 0.020 g of the compound (A-8) having the following structure were dispersed and dissolved in one liter of Isopar H to prepare a liquid developer for mother liquid.

Charge Generating Agent (A-8)

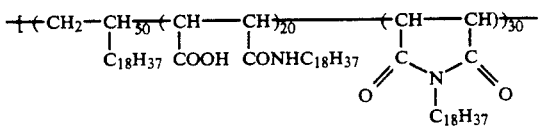

Liquid Developer for Replenisher (Example 8 and Comparative Examples B and C)

Predetermined amounts of the compounds indicated in Table 2 were dispersed and dissolved in one liter of Isopar H to prepare a developer for replenisher according to the present invention and comparative developers for replenishers.

The electrophotographic material, ELP Master I Type, was used and duplication was repeatedly conducted in a full automatic plate making machine ELP-330 (manufactured by Fuji Photo Film Co., Ltd.) in the following manner, at a plate making speed of 3 plates/-min.

First, the above-described developer for mother liquid was charged into ELP-330. Thereafter, each of the developers of Example 8 and Comparative Examples B and C was used as the developer for replenisher, and the degree of repetition stability was examined. The results are shown in Table 2.

TABLE 2

| Components of liquid developer for replenisher | Example 8 (Invention) | Comparative Example B | Comparative Example C |
|---|---|---|---|
| Dispersed resin particles L-2 | 21 g | 21 g | 21 g |
| Colored particles D-2 | 2.4 g | 2.4 g | 2.4 g |
| Charge generating agent (A-8) | 0.04 g | 0.08 g | 0.06 g |
| Charge inhibiting agent (B-3) FOC-1400 | 39 g | 39 g | 39 g |
| A/B ratio (the A/B ratio contained in the developer for mother liquid) | 0.67 | 1.33 | 1.00 |
| The number of processed plates having clear image | 12,000 plates | 1,500 plates | 4,000 plates |

When duplication was conducted with the developer for replenisher according to the present invention, a clear image could be obtained until 12,000 plates were repeatedly processed.

On the other hand, when the developers of Comparative Examples B and C were used, a lowering in the density of the image and the streak of the image occurred when 1,500 plates and 4,000 plates were processed, respectively.

From the above results, it is noted that only the combination of the developer for mother liquid and the developer for replenisher according to the present invention retains repitition stability over a very long period of time.

EXAMPLES 9 TO 17

Liquid developers were prepared in the same manner as in Example 8 except that compounds indicated in Table 3 were used in place of the charge generating agent (A-8) and the charge inhibiting agent (B-3) used in Example 8. Duplication was conducted and the degree of repetition stability was examined. The results obtained are also shown in Table 3 below.

As is noted from the results in Table 3, the developer for mother liquid and the developer for replenisher used in combination according to the present invention show a clear image even when 10,000 plates or more were repeatedly processed.

TABLE 3

| Example | Developer for mother liquid (A) | Developer for mother liquid (B) | Developer for replenisher (A) | Developer for replenisher (B) | (A)/(B) ratio | The number of processed plates having clear image |
|---|---|---|---|---|---|---|
| 9 | (A-2) 0.017 g | (B-2) 16 g | (A-2) 0.040 g | (B-2) 48 g | 0.78 | 14,000 plates |
| 10 | (A-3) 0.02 g | (B-1) 18 g | (A-3) 0.05 g | (B-2) 54 g | 0.83 | 10,000 plates |
| 11 | (A-4) 0.02 g | (B-2) 18 g | (A-4) 0.048 g | (B-2) 50.4 g | 0.86 | 11,000 plates |
| 12 | (A-1) 0.015 g | (B-1) 18 g | (A-1) 0.032 g | (B-1) 45 g | 0.85 | 12,000 plates |
| 13 | (A-5) 0.05 g | (B-3) 14 g | (A-5) 0.09 g | (B-3) 42 g | 0.60 | 10,000 plates |
| 14 | (A-6) 0.07 g | (B-1) 16 g | (A-6) 0.16 g | (B-1) 44.8 g | 0.81 | 11,000 plates |
| 15 | (A-7) 0.06 g | (B-4) 12 g | (A-7) 0.14 g | (B-2) 31.2 g | 0.90 | 13,000 plates |
| 16 | (A-8) 0.02 g | (B-1) 16 g | (A-8) 0.05 g | (B-3) 51.2 g | 0.78 | 12,000 plates |
| 17 | (A-4) 0.01 g (A-6) 0.03 g | (B-2) 18 g | (A-4) 0.02 g (A-6) 0.06 g | (B-2) 54 g | 0.67 | 11,000 plates |

EXAMPLE 18

Preparation of Colored Resin Grains DL-1

One gram of carbon black (#40 manufactured by Mitsubishi Kasei Corporation) and 2 g of an octadecyl methacrylate/methyl methacrylate copolymer (1/9 molar ratio) were mixed and melt-kneaded at 120° C. for 30 minutes in a three-roll mill. The mixture was cooled to room temperature and coarse-crushed and finely divided in a hammer mill and a pin mill.

A mixture of 3 g of the above-prepared finely divided material, 20 g of Solprene 1205 (manufactured by Asahi Chemical Industry Co., Ltd.) and 437 g of Isopar H was pre-dispersed in an attritor, and then final dispersion was carried out at a peripheral speed of 10 m/sec in a supermill for 2 hours. The thus obtained dispersion was a concentrated solution having a solid content of 13 wt%. During the dispersion, the temperature was kept at 35° C.

The components shown in Table 4 in the indicated amounts were dispersed or dissolved in one liter of Isopar G to prepare each of a developer for mother liquid and a developer for replenisher.

TABLE 4

| Components of developer composition | Liquid developer for mother liquid | Liquid developer for replenisher |
|---|---|---|
| Colored resin particles: DL-1 | 10 g | 28 g |
| Charge generating agent (A-9) having the following structure | 0.04 g | 0.09 g |
| Charge inhibiting agent (B-1) | 20 g | 56 g |

Compound (A-9)

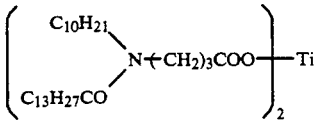

When the repetition stability of the duplicated images was examined in the same manner as in Example 8 it was found that the stable image could be obtained until 8,000 plates.

EXAMPLES 19 TO 24

Preparation of Colored Resin Particles DL-2 to DL-7

A mixture of 100 g of the dispersed resin particles (L-2) and 3 g of a dye shown in Table 5 was heated to a temperature of from 70° to 80° C. and stirred for 6 hours. The mixture was cooled to room temperature and passed through a 200-mesh nylon cloth. The dye left on the cloth was removed to obtain dyed dispersed resin particles. The resin particles had an average particle size of 0.22 to 0.25 μm.

TABLE 5

| Colored resin particles | Dye used for dyeing |
|---|---|
| DL-2 | Victoria Blue |
| DL-3 | Aizen Cathilon Yellow 3GLH (Hodogaya Chemical Co., Ltd.) |
| DL-4 | Aizen Cathilon Pink FGH (Hodogaya Chemical Co., Ltd.) |
| DL-5 | Aizen Astra Phloxine FF (Hodogaya Chemical Co., Ltd.) |
| DL-6 | Methylene Blue |
| DL-7 | Spirit Black (Orient Kasei Co.) |

Liquid developers were prepared in the same manner as in Example 18 except that resin particles shown in Table 6 were used in place of the colored resin particles DL-1 used in the developer for mother liquid and the developer for replenisher in Example 18.

TABLE 6

| Example | Colored resin particles | Example | Colored resin particles |
|---|---|---|---|
| 19 | DL-2 | 22 | DL-5 |
| 20 | DL-3 | 23 | DL-6 |
| 21 | DL-4 | 24 | DL-7 |

The repetition stability of duplicated images were examined in the same manner as in Example 8 using these developers. It was found that at least 7,000 plates having a stable image could be obtained by the duplication operation.

EXAMPLES 25 TO 28

Liquid developers for mother liquid and liquid developers for replenishers were prepared in the same manner as in Example 8 except that compounds (B) shown in Table 7 were used in place of the charge inhibiting agent (B-3) used in Example 8.

TABLE 7

| Example | (B) | Charge inhibiting agent (B) |
|---|---|---|
| 25 | (B-7) | 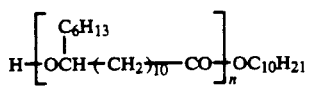 |
| 26 | (B-8) | 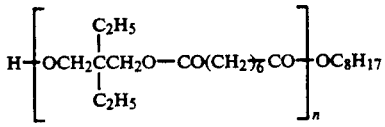 |
| 27 | (B-9) | 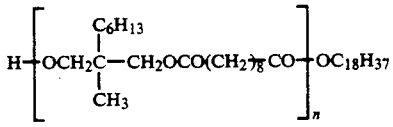 |
| 28 | (B-10) | 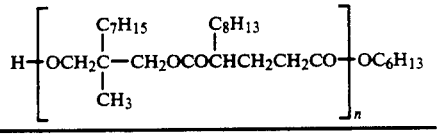 |

The repetition stability of duplicated images was examined in the same manner as in Example 8 using these developers. It was found that at least 7,000 plates having a stable image could be obtained by the duplication operation.

According to the present invention, very fine original images including continuous tone images can be stably duplicated over a long period of time substantially without causing changes in the image quality, and the sensitivity, even when a large number of electrophotographic materials are developed. Further, even when environmental conditions are changed to such as low temperature and low humidity or high temperature and high humidity, the original images can be stably reproduced.

The object of the present invention is to provide a duplicating method using a liquid developer for electrostatic photography wherein very fine original images including continuous tone images can be stably duplicated while the changes of image quality and sensitivity are inhibited when a large number of prints are developed. Further, the object of the present invention is to provide a duplicating method wherein the original images can be stably duplicated even when environmental conditions change to low temperature and low humidity conditions or high temperature and high humidity conditions.

The present invention provides a duplicating method wherein electrostatic duplication is conducted with a liquid developer for electrostatic photography which contains toner grains mainly composed of a resin in a non-aqueous solvent having an electric resistance of at least $10^9$ Ω·cm and a dielectric constant of not higher than 3.5, wherein the liquid developer contains (a) a compound (A) having an effect of increasing the amount of charge and (b) a compound (B) having an effect of reducing the amount of charge.

While the invention has been described in detail and with reference to specific embodiments thereof, it will be apparent to one skilled in the art that various changes and modifications can be made therein without departing from the spirit and scope thereof.

What is claimed is:

1. A combination of a liquid developer and a replenisher for the liquid developer for use in electrostatic photography, wherein the liquid developer comprises a non-aqueous solvent having an electric resistance of at least $10^9$ Ω·cm and a dielectric constant of not higher than 3.5, toner grains comprising a resin as a main component, and (a) at least one compound (A) in an amount of about 0.0001 to about 1 part by weight per 1,000 parts by weight of the non-aqueous solvent and having an effect of increasing the amount of charge, and (b) at least one compound (B) in an amount of about 1 to about 500 parts by weight per 1,000 parts by weight of the non-aqueous solvent and having an effect of reducing the amount of charge; and wherein the replenisher for the liquid developer comprises said at least one compound (A) and said at least one compound (B) in a weight ratio (A)/(B) of at least 0.1 time, but less than 1.0 time the weight ratio (A)/(B) of said at least one compound (A) to said at least one compound (B) contained in the liquid developer used at commencement of development.

2. The combination as claimed in claim 1, wherein said at least one compound (A) is selected from the group consisting of metal salts of naphthenic acid, metal salts of dioctyl sulfosuccinate, lecithin, amino acid compounds represented by formula (1) or (2):

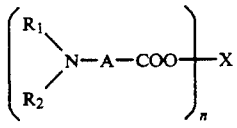

(1)

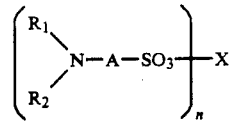

(2)

wherein $R_1$ and $R_2$, which may be the same or different, each represents a hydrogen atom, a substituted or unsubstituted alkyl group having 1 to 22 carbon atoms, a substituted or unsubstituted aryl group having 6 to 24 carbon atoms, an aralkyl group, an acyl group having 1 to 22 carbon atoms, an alkylsulfonyl group, an alkylphosphonyl group, an arylsulfonyl group having 6 to 24 carbon atoms or an arylphosphonyl group having 6 to 24 carbon atoms, provided that $R_1$ and $R_2$ may be combined together to form a ring and $R_1$ and $R_2$ do not simultaneously represent hydrogen atoms, A represents an alkylene group or a substituted alkylene group having 1 to 10 carbon atoms, X represents a hydrogen atom, a monovalent to tetravalent metal or a quaternary ammonium cation, and n represents a positive integer; a reaction mixture obtained by reacting an amino acid compound with a titanium compound in an organic solvent, mixing the resulting mixture with water and allowing the resulting mixture to react; and semialkylamide compounds of maleic acid copolymers comprising a repeating unit represented by formula (3):

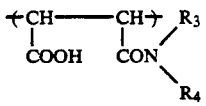

(3)

wherein $R_3$ and $R_4$ having the same meaning as said $R_1$ and $R_2$.

3. The combination as claimed in claim 1, wherein said at least one compound (B) is a hydrocarbon compound having at least 6 carbon atoms and containing a hetero atom selected from the group consisting of oxygen, sulfur and nitrogen, and/or an oligomer comprising a repeating unit of said hydrocarbon compound, said hydrocarbon compound and said oligomer having a solubility in toluene solvent such that at least one part by weight of said compound (B) is soluble in 100 parts by weight of toluene solvent at a temperature of 25° C.

4. A duplicating method which comprises conducting electrostatic duplication with a liquid developer and a replenisher for the liquid developer, wherein the liquid developer comprising a non-aqueous solvent having an electric resistance of at least $10^9$ Ω·cm and a dielectric constant of not higher than 3.5, toner grains comprising a resin as a main component, and (a) at least one compound (A) in an amount of about 0.0001 to about 1 part by weight per 1,000 parts by weight of the non-aqueous solvent and having an effect of increasing the amount of charge, and (b) at least one compound (B) in an amount of about 1 to about 500 parts by weight per 1,000 parts by weight of the non-aqueous solvent and having an effect of reducing the amount of charge; and wherein the replenisher for the liquid developer comprises said at least one compound (A) and said at least one compound (B) in a weight ratio (A)/(B) of at least 0.1 time, but less than 1.0 time the weight ratio (A)/(B) of said at least one compound (A) to said at least one compound (B) contained in the liquid developer used at commencement of development.

5. The duplicating method as claimed in claim 4, wherein said at least one compound (A) is present in the liquid developer in an amount of about 0.005 to about 0.5 parts by weight per 1,000 parts by weight of said non-aqueous solvent.

6. The duplicating method as claimed in claim 4, wherein said at least one compound (B) is present in the liquid developer in an amount of about 10 to about 150 parts by weight per 1,000 parts by weight of said non-aqueous solvent.

7. The duplicating method as claimed in claim 4, wherein said liquid developer further comprises a coloring agent.

8. The method as claimed in claim 4, wherein said weight ratio (A)/(B) of the at least one compound (A) to the at least one compound (B) is at least 0.3 time, but less than 0.8 time.

9. The duplicating method as claimed in claim 4, wherein said at least one compound (A) is selected from the group consisting of metal salts of naphthenic acid, metal salts of dioctyl sulfosuccinate, lecithin, amino acid compounds represented by formula (1) or (2):

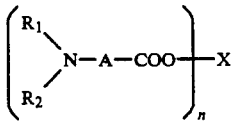

(1)

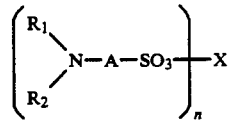

(2)

wherein $R_1$ and $R_2$, which may be the same or different, each represents a hydrogen atom, a substituted or unsubstituted alkyl group having 1 to 22 carbon atoms, a substituted or unsubstituted aryl group having 6 to 24 carbon atoms, an aralkyl group, an acyl group having 1 to 22 carbon atoms, an alkylsulfonyl group, an alkylphosphonyl group, an arylsulfonyl group having 6 to 24 carbon atoms or an arylphosphonyl group having 6 to 24 carbon atoms, provided that $R_1$ and $R_2$ may be combined together to form a ring and $R_1$ and $R_2$ do no simultaneously represent hydrogen atoms, A represents an alkylene group or a substituted alkylene group having 1 to 10 carbon atoms, X represents a hydrogen atom, a monovalent to tetravalent metal or a quaternary ammonium cation, and n represents a positive integer; a reaction mixture obtained by reacting an amino acid compound with a titanium compound in an organic solvent, mixing the resulting mixture with water and allowing the resulting mixture to react; and semialkylamide compounds of maleic acid copolymers comprising a repeating unit represented by formula (3):

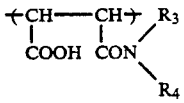

(3)

wherein $R_3$ and $R_4$ having the same meaning as said $R_1$ and $R_2$.

10. The duplicating method as claimed in claim 4, wherein said at least one compound (B) is a hydrocarbon compound having at least 6 carbon atoms and containing a hetero atom selected from the group consisting of oxygen, sulfur and nitrogen, and/or an oligomer comprising a repeating unit of said hydrocarbon compound, said hydrocarbon compound and said oligomer having a solubility in toluene solvent such that at least one part by weight of said compound (B) is soluble in 100 parts by weight of toluene solvent at a temperature of 25° C.

11. The combination as claimed in claim 1, wherein said at least one compound (A) is present in the liquid developer in an amount of about 0.005 to about 0.5 parts by weight per 1,000 parts by weight of said non-aqueous solvent.

12. The combination as claimed in claim 1, wherein said at least one compound (B) is present in the liquid developer in an amount of about 10 to about 150 parts by weight per 1,000 parts by weight of said non-aqueous solvent.

13. The combination as claimed in claim 1, wherein said liquid developer further comprises a coloring agent.

14. The combination as claimed in claim 1, wherein said weight ratio (A)/(B) of the at least one compound (A) to the at least one compound (B) is at least 0.3 time, but less than 0.8 time.

* * * * *